United States Patent [19]

Findlay

[11] 3,975,852

[45] Aug. 24, 1976

[54] SIGNAL LAUNCHER

[75] Inventor: David Findlay, Guilford, Conn.

[73] Assignee: Bellmore-Johnson Tool Co., Hamden, Conn.

[22] Filed: Feb. 20, 1975

[21] Appl. No.: 551,332

[52] U.S. Cl. ..... 42/40; 42/1 Z

[51] Int. Cl.[2] ..... F41C 3/02

[58] Field of Search ..... 42/1 Z, 40, 41, 63, 42/64

[56] References Cited

UNITED STATES PATENTS

| | | | |
|---|---|---|---|
| 227,449 | 5/1880 | Schofield | 42/63 |
| 530,759 | 12/1894 | Foehl | 42/63 |
| 847,837 | 3/1907 | Shimer | 42/40 |
| 1,779,770 | 10/1930 | Harrington | 42/40 |
| 2,097,023 | 10/1937 | Driggs, Jr. et al. | 42/1 Z |
| 2,351,268 | 6/1944 | Jackson | 42/1 Z |
| 2,360,168 | 10/1944 | Severance et al. | 42/1 Z |

*Primary Examiner*—Charles T. Jordan
*Attorney, Agent, or Firm*—DeLio and Montgomery

[57] ABSTRACT

A pistol-type signal launcher having a spring-actuated hammer carrying the firing pin, a pivotally mounted barrel releasably retained in firing position by a plunger which is biased toward the barrel support cam by a spring which also biases the trigger toward cocked position, moving the sear into engagement with the hammer base; the hammer spring acts on the hammer through a rebound cam.

4 Claims, 4 Drawing Figures

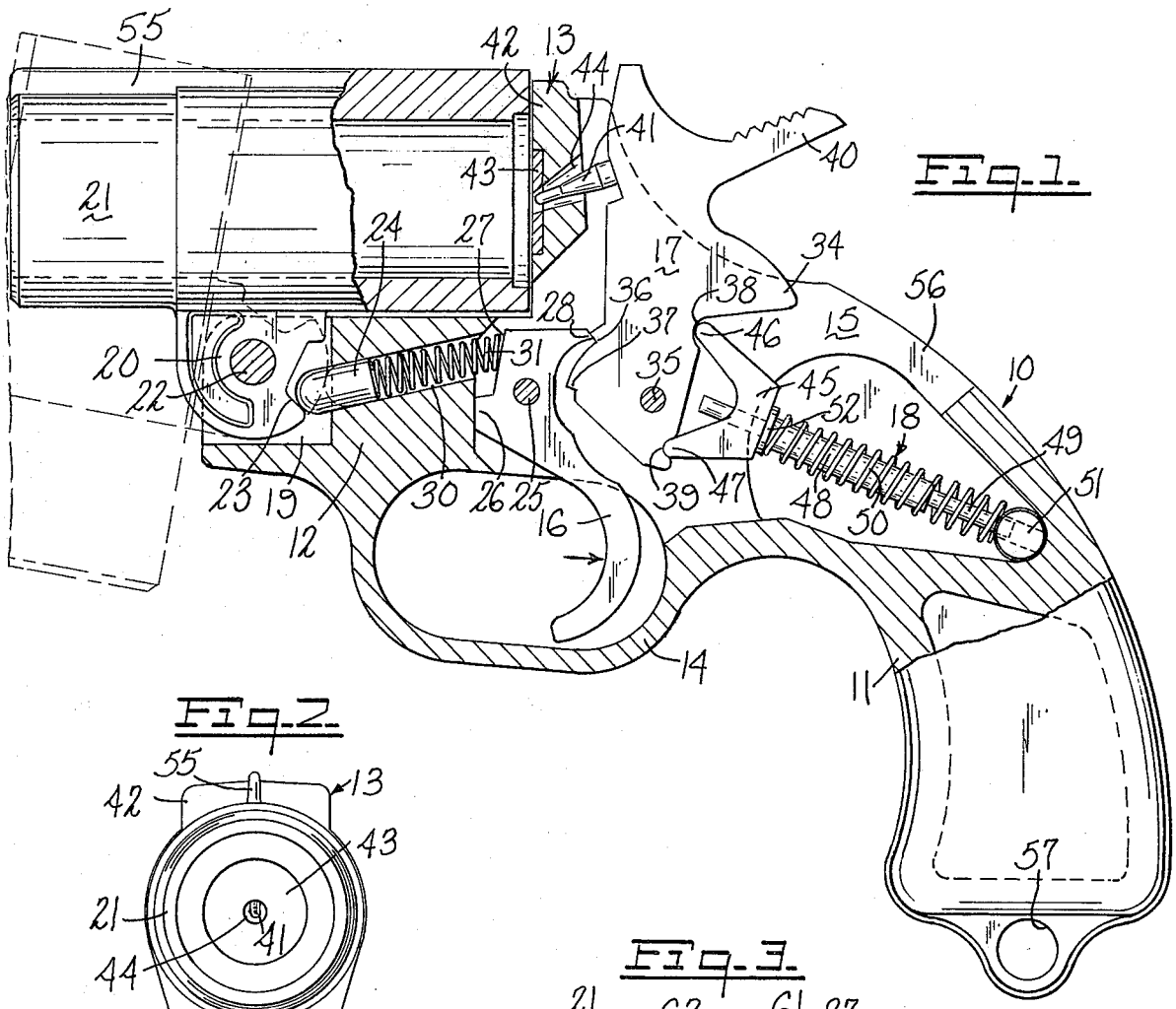
Fig. 1.
Fig. 2.
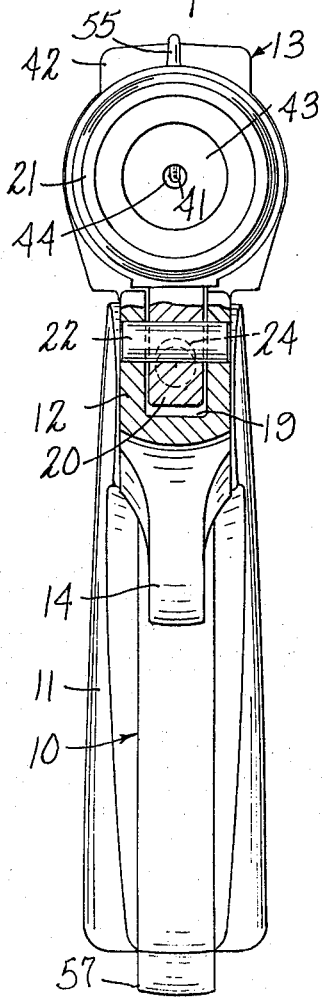
Fig. 3.
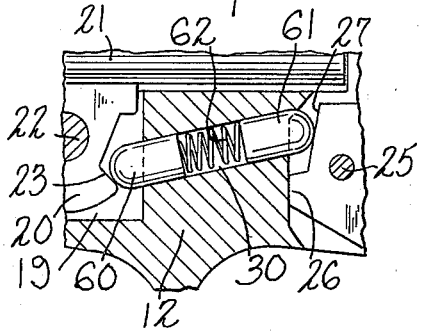
Fig. 4.
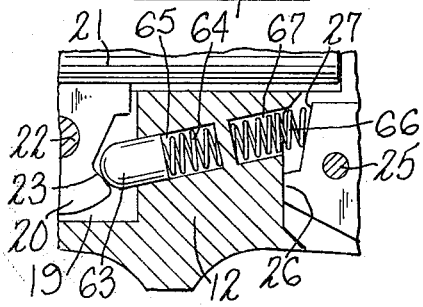

SIGNAL LAUNCHER

This invention relates to a piston-type signal launcher having a frame with grip portion, a pivotally mounted barrel, a spring-actuated hammer carrying the firing pin, a double-acting spring assembly, one end of which acts to retain the barrel in firing position and the other end of which biases the trigger toward cocked position, and a hammer spring acting on the hammer through a rebound cam. The launcher is based on the well-known Very pistol but includes design features rendering it more sophisticated and versatile.

It is an object of the invention to provide a signal launcher of strong and simple construction which is easy to operate.

It is a further object of the invention to provide a signal launcher wherein the parts cooperate to lock the hammer in safety position after each firing.

It is another object of the invention to provide a signal launcher wherein the barrel has a sighting rib to facilitate aiming.

It is a still further object of the invention to provide a signal launcher wherein the frame is designed to have a visual vantage point for convenient inspection and maintenance of the hammer spring.

It is yet another object of the invention to provide a signal launcher wherein the above named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawing wherein:

FIG. 1 represents a vertical longitudinal section of the launcher, in safety position, the open (loading) position of the barrel being indicated in broken lines;

FIG. 2 represents a muzzle end elevation of the launcher, parts being cut away and parts shown in section;

FIG. 3 represents a detail vertical section showing a modified form of double-acting spring, and FIG. 4 represents a detail vertical section showing separation of the double-acting spring into two separate springs.

Referring to the drawing, the launcher has a frame 10 which includes the grip portion 11, the barrel mounting portion 12, the breech portion 13 and the trigger guard 14. The frame is centrally recessed, as indicated at 15, to receive the trigger 16, hammer assembly 17 and rebound cam assembly 18, and a separate slot 19, open forwardly and upwardly, receives the support cam 20 of the barrel 21.

The barrel is cylindrical, mounted centrally on the support cam 20 which is pivoted on the pin 22 in the slot 19, the cam having a radially disposed camming surface 23 adapted to receive the rounded end of plunger 24, constituting part of a double-acting spring assembly, for retention of the barrel in firing position. The surface 23 is lower than the axis of pin 22 and the force of plunger 24 has a somewhat tangential moment so that the barrel is positively urged toward the closed (firing) position.

The trigger 16 is pivotally mounted on the cross pin 25 and is shaped to have a stop lug 26, bearing normally against the front wall of the recess 15, a spring abutment 27 and a sear 28. The double-acting spring assembly lies mainly in a bore 30 extending downward from recess 15 to slot 19, and comprises the plunger 24 and compression spring 31 the rear end of which bears on the abutment 27, so that the assembly, at its rear end, urges the trigger towards its rest position and, at its forward end, holds the barrel in firing position.

The hammer assembly 17 is pivoted on the cross pin 35 and is formed with forwardly facing teeth 36, 37 each adapted to engage the end of the sear 28 and with rearwardly facing upper and lower seats 38, 39 for engagement by the rebound cam, as explained below. Upwardly, the hammer assembly comprises the cocking finger piece 40 and the firing pin 41, mounted in the front face of the hammer. The rearwardly projecting arm 34 acts as a stop to limit the extent of the cocking movement.

The breech portion 13 of the frame includes the breech block 42 and a face plate 43, both of which are traversed by the generally conical opening 44 through which the firing pin is projected in order to detonate a cartridge (not shown) in the rear end of the barrel.

The rebound cam assembly 18 comprises the bifurcated cam 45 having its spaced upper and lower ends 46, 47 seated in the seats 38, 39 on the rear of the hammer. The cam is mounted on the reduced front end of the cam strut 48, the reduced rear end 49 of which fits freely in a diametrical bore through the cylindrical strut bearing 51. The cam is urged forwardly by the compression spring 50, acting between the strut collar 52 at the rear of the cam and the surface of the spring strut bearing 51 which rests in the rear end of the frame cavity 15.

In the "at rest" or safety position of the parts, the sear is engaged (or nearly so) with the upper tooth 36, the cam ends 46, 47 rest in their respective seats 38, 39 and the point of the firing pin lies within the opening 44. The cam and hammer assemblies are in equilibrium and the firing pin is not urged forward; so long as the sear is in a position to engage the tooth 36, the firing pin cannot be forced forward.

In operation, the barrel is rocked forward to loading position (broken lines in FIG. 1), a suitable flare or other rigid shell is inserted, the barrel is snapped closed, the hammer is cocked (engaging the sear with tooth 37) and the shell is fired by pulling the trigger, as usual. In its cocked position the cam 45 engages the hammer only through the upper end 46 resting in seat 38 and arm 34 resting against the upper side of the cam. When the trigger is pulled to release the hammer, the latter reaches its greatest rotational velocity as it passes the position of rest (FIG. 1) so that it easily goes past that position by the few degrees necessary to permit the firing pin to traverse the opening and detonate the shell. At that point, however, the cam 45 is acting on the hammer only through the lower end 47 in seat 39, so that the cam causes the hammer to rebound, returning the firing pin immediately to its rest position. The trigger being released, tooth 36 is engaged (or nearly so) by the sear and the mechanism is in safe condition, this condition being assumed automatically after each firing. The recoil factor is negligible.

Other features which augment the utility and convenience of the signal launcher are the straight raised sighting rib 55, the extended opening 56 in the top of the grip portion (to facilitate observation and servicing of the cam assembly and hammer) and the lanyard loop 57.

FIG. 3 shows a modified form of double-acting spring assembly wherein plungers 60, 61 are placed at both ends of the spring 62; plunger 60 and spring 62 correspond to plunger 24 and spring 31 in FIG. 1 while the second plunger 61 bears against the abutment 27, as did the spring 31. In FIG. 4 the double-acting spring assembly is replaced by a plunger 63 and spring 64 in a dead-end bore 65, acting on the barrel support cam, and by a plain spring 66 in an oppositely facing dead-end bore 67, acting on the trigger abutment.

The barrel and frame may suitably be constructed of a corrosion-resistant aluminum alloy with high tensile strength, while the hammer, trigger and rebound cam are made of other alloys to assure reliable operation. The grip portion is normally provided with durable plastic panels having non-skid surface configurations. Flares, depending on their type, can be launched to heights of 200 ft. to 250 ft. and may burn for a number of seconds with 10,000 c.p. or more and visibility of at least 20 miles.

It will be understood that various changes may be made in the form, construction and arrangement of the several parts without departing from the spirit and scope of the invention and it is intended that all matter contained in the above description or shown in the accompanying drawing shall be interpreted as illustrative and not in a limiting sense.

What we claim is:

1. A pistol-type signal launcher comprising a frame having a grip portion, a barrel mounting portion, a breech portion and a central upwardly open recess, a hammer and a trigger each pivotally mounted in said recess, a barrel, a support cam fixed on the barrel and pivotally mounted in the barrel mounting portion, and resilient means engaging both said cam and said trigger, the barrel mounting portion being provided with a slot, the support cam being mounted in said slot, and the frame being provided with a bore extending between the central recess and said slot, the bore lying at an angle to the horizontal extending downwardly from the recess to the slot and the resilient means being disposed in said bore.

2. A signal launcher according to claim 1 wherein the resilient means engages the cam surface with a force moment biasing the barrel toward closed firing position.

3. A pistol-type signal launcher comprising a frame having a grip portion, a barrel mounting portion, a breech portion and a central upwardly open recess, a hammer and a trigger each pivotally mounted in said recess, a barrel, a support cam fixed on the barrel and pivotally mounted in the barrel mounting portion, and resilient means engaging both said cam and said trigger, said resilient means comprising an assembly of at least one plunger and one spring, the cam being engaged by the plunger.

4. A signal launcher according to claim 3 wherein said resilient means comprises an assembly of two plungers and one spring, the cam and the trigger being engaged by the plungers.

* * * * *